United States Patent [19]

Harrison

[11] 4,274,046

[45] Jun. 16, 1981

[54] AC RESONANCE TRANSFORMER

[75] Inventor: John L. Harrison, San Diego, Calif.

[73] Assignee: Maxwell Laboratories, Inc., San Diego, Calif.

[21] Appl. No.: 916,781

[22] Filed: Jun. 19, 1978

Related U.S. Application Data

[63] Continuation-in-part of Ser. No. 909,115, May 24, 1978, abandoned.

[51] Int. Cl.[2] ..... G05F 3/04

[52] U.S. Cl. ..... 323/355; 323/306

[58] Field of Search ..... 307/106–108, 307/264; 323/74, 76, 124; 328/53, 65, 67, 84; 331/87; 333/24 R, 167, 175

[56] References Cited

U.S. PATENT DOCUMENTS

| | | | |
|---|---|---|---|
| 2,461,321 | 2/1949 | Guillemin | 328/65 X |
| 2,496,979 | 2/1950 | Blumlein | 328/67 X |
| 2,542,066 | 2/1951 | Varela | 333/24 R |
| 2,773,199 | 12/1956 | Scoles | 307/108 |

*Primary Examiner*—A. D. Pellinen

*Attorney, Agent, or Firm*—Fitch, Even, Tabin, Flannery & Welsh

[57] ABSTRACT

An a.c. Resonance Transformer for operating at a predetermined frequency. The transformer comprises a resonant $\pi$-type or T-type stage. The $\pi$-type stage includes three series connected four-terminal networks. The first of the networks and the third of the networks includes a shunt reactor of a first type. The second of the networks includes two series connected second type reactors and a first type reactor shunt connected to the junction between the second type reactors. The reactors in the second of the networks are sized so that when an input signal of a predetermined frequency is applied to the input of the first of the networks, a 180° phase shift is provided between the phase angle of the input and output voltage vectors of the second of the networks and so that a zero input impedance is provided when the output is short circuited.

23 Claims, 9 Drawing Figures

Fig. 7.
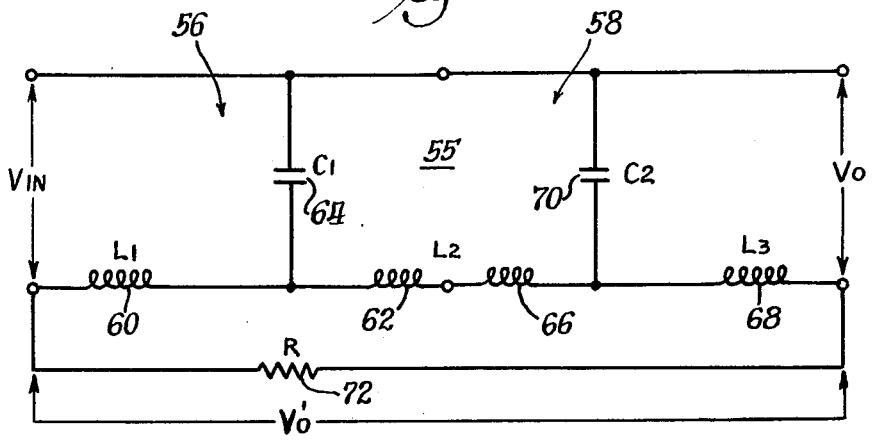
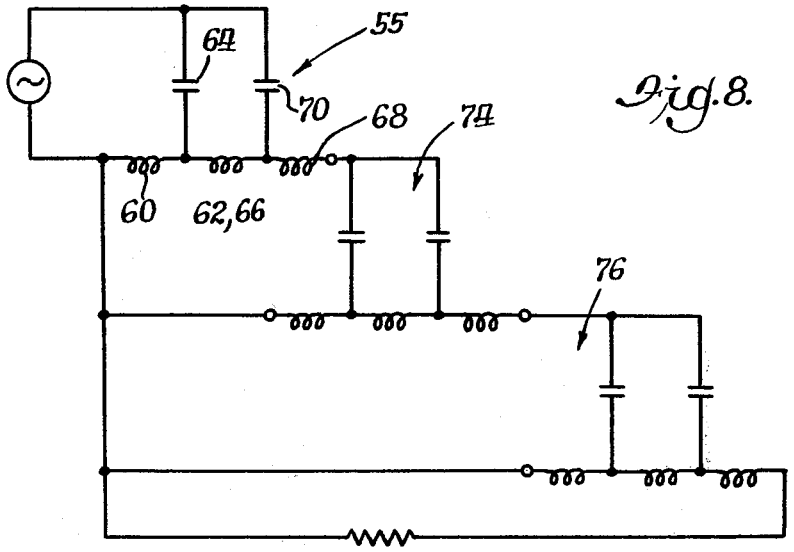
Fig. 8.
Fig. 9.
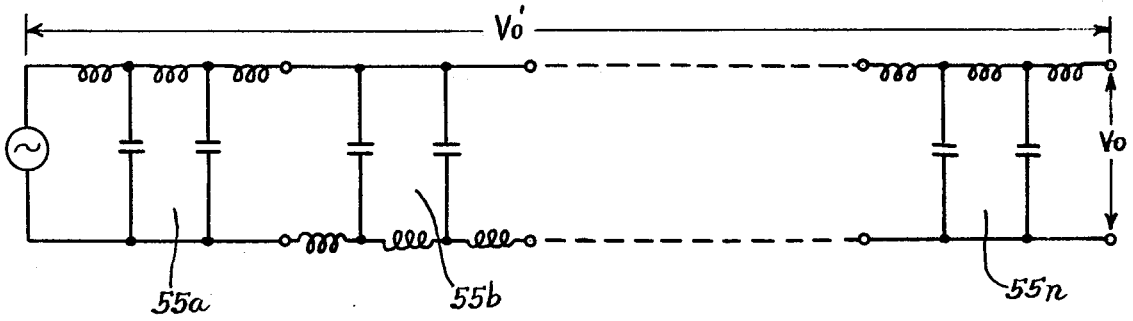

AC RESONANCE TRANSFORMER

This application is a continuation-in-part of my prior application, Ser. No. 909,115, May 24, 1978, now abandoned.

This invention relates generally to a resonance transformer and more particularly to a resonance transformer that has characteristics similar to those of a two winding conventional transformer.

In the past, iron core or air core transformers have been used for stepping up or stepping down the voltage, or current, of an a.c. system. However, in applications such as for transportable power systems (viz., airborne and space applications), the weight and size of the required transformer is undesirable or impractical. It has been suggested that it may be possible to use, a series resonant circuit which is excited by a driving signal at the resonant frequency of the circuits to replace the transformer. The driving signal would be stepped up, or down by the resonant circuit for application to a load. However, it has been found that such series resonance circuit tend to store a relatively large amount of energy as compared to what they deliver to the load, are difficult to tune, and the gain of such circuits varies in proportion to the load impedance. Also, the components comprising such series resonant circuits were found to be relatively large and heavy, especially for higher gains.

Accordingly, it is an object of this invention to provide an improved resonance transformer for stepping up, or down voltages or currents of a high power signal.

It is a more specific object of the invention to provide an improved transformer which is lighter than conventional transformers and which is capable of delivering a substantial amount of its stored energy to a load during each cycle.

These and other objects of the invention will become more apparent by reference to the following description and accompanying drawings wherein:

FIG. 7 is a schematic drawing showing another embodiment of a transformer stage of a resonance transformer;

FIG. 8 is schematic drawing showing a stepped or ladder arrangement of three of the stages shown in FIG. 7; and FIG. 9 is a schematic drawing showing a plurality of stages shown in FIG. 7 coupled in series.

Figure 1:
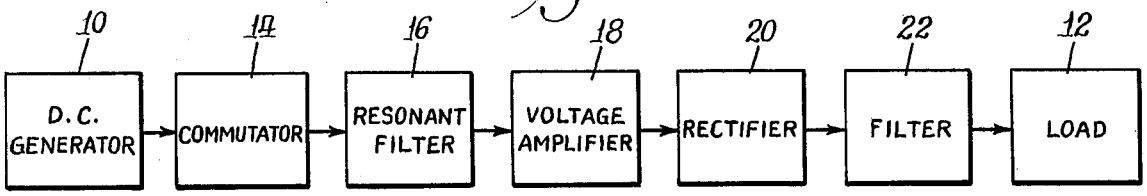
FIG. 1 is a block diagram of a DC to DC converter employing a resonance transformer made in accordance with the present invention.

Generally, as disclosed in the drawings, a resonance transformer in accordance with the present invention is designed to operate at a predetermined frequency. The transformer comprises at least one resonant stage which includes either two $\pi$-type or two T-type circuits connected in series. In the embodiments shown in FIGS. 2 to 6 $\pi$-type stages are employed while in FIGS. 7 to 9 T-type stages are employed. The $\pi$-type stage includes three four terminal networks connected in series. The first and third networks each includes a shunt reactor of a first type (i.e., an inductor or a capacitor). The second network includes two series connected second type reactors and a first type reactor shunt connected to the junction between the second type reactors. The predetermined frequency is applied to the input of the first network. The reactors of the second stage have component values such as to provide a 180° phase shift at the predetermined frequency between the phase angle of its input and output voltage vectors and to provide a zero input impedance when its output is short circuited.

The disclosed resonance transformer is particularly adapted for stepping up either the voltage or current of a high power signal, i.e., having a power that exceeds one megawatt, and in applications where compactness and lightweight are important considerations such as for transportable power systems. The resonance transformer is particularly advantageous for use with a relatively low voltage, high internal source impedance and constant power DC generator, such as an MHD generator. FIG. 1 shows the resonance transformer employed with the DC generator 10 to step up the output of the generator to provide a high voltage DC signal to a load 12. The DC output of the generator 10 is converted to AC by a suitable inverting means such as a commutator 14 connected to a resonant filter 16. The commutator 14 is a switching circuit that sequentially opens and closes its switches (not shown) to generate the required output frequency. The frequency of the commutator 14 should be as high as possible (viz., above about 1 kilohertz) because this will minimize the size of the reactive elements of the resonance transformer. The commutator 14 may be a conventional bridge type including a silicon controlled rectifier in each leg with a reverse diode connected thereacross.

The output of the commutator 14 is connected to the resonant filter 16 which performs two functions. At the end of each commutating period, it provides a positive reverse voltage bias to the commutating switches with a sufficent duration to allow the switch to recover its forward blocking characteristics. Also, the resonant filter 16 modifies the nearly rectangular waveshape delivered to its input terminals so that the signal at its output it pure sinusoid. The resonant filter 16 may be of the conventional series resonant type.

The output of the resonant filter 16 is connected to the input of the voltage amplifier 18 which steps up the voltage in the AC signal applied to its input. The output of the resonance transformer 18 is connected to a conventional rectifier 20, the output of which is connected through a conventional filter 22 to the load 12.

Figure 2:
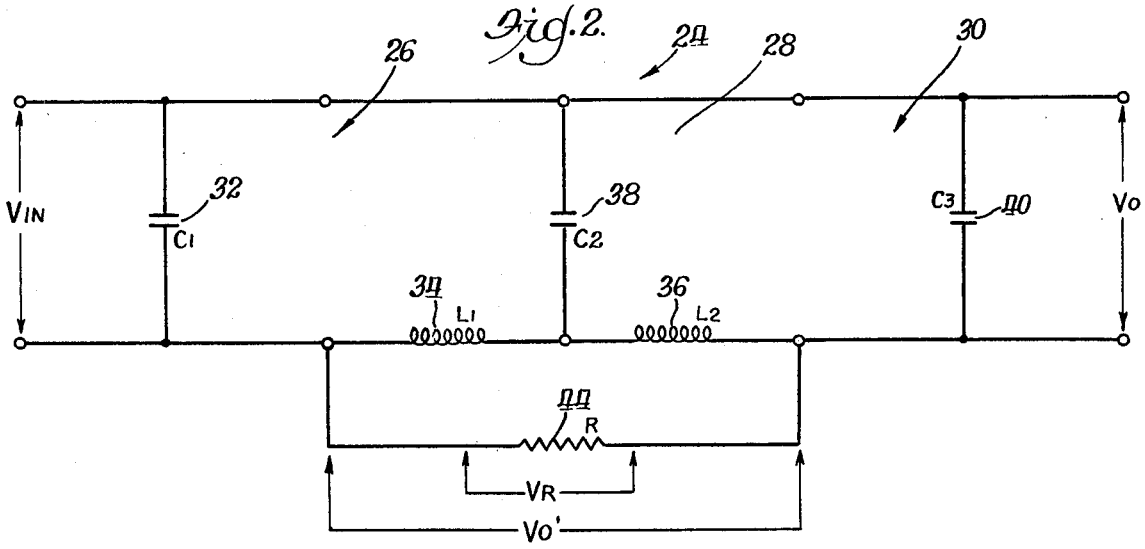
FIG. 2 is a schematic drawing showing one embodiment of a transformer stage of a resonance transformer constructed in accordance with the present invention.

FIG. 2 shows an embodiment of one resonant $\pi$-type stage 24 of the voltage amplifier 18. The stage 24, includes three four-terminal networks 26, 28 and 30 connected in series. The first network 26 includes a shunt capacitor 32. The second network includes two series connected inductors 34 and 36 and a shunt capacitor 38 connected to the junction between the two series inductors 34 and 36. The third network 30 includes a shunt capacitor 40. The shunt capacitor 38 includes the output capacitor of the first $\pi$-type circuit and the input capacitor of the second $\pi$-type circuit.

The component values of the second network 28 are selected so that it provides a 180° phase shift at the applied frequency between the phase angle of its input and its output voltage vectors (i.e., the resonant frequency of the second network is the applied frequency) and so that it has zero input impedance when its output is short circuited. The component value of the shunt capacitor 32 in the first network 26 is selected to provide the desired power factor of the stage 24. In the stage described hereinafter, the stage is designed for a unity power factor. However, a leading power factor may be desirable in certain applications such as where it is desired to provide a soft commutation of the switches in the commutator 14 and thereby eliminate the need for the resonant filter 16. To provide a leading phase shift in the current, the capacitance in the first network 26 should be increased from that provided for unity power factor.

The component value of the shunt capacitor 40 in the third network 30 is selected to minimize the reactive energy stored in the stage to thereby minimize the peak voltage across the components. In the stage described hereinafter, the component value of the capacitor 40 is selected for a purely resistive load. However, the component value may be adjusted to compensate for reactive current in the load.

A load may be connected in parallel with the shunt capacitor 40. However, to permit a maximum gain to be obtained in the stage 24, the load of the stage, which is illustrated as a resistance 44, is connected in parallel with the series inductors 34 and 36.

It has been found to obtain the 180° phase angle between the input and output vectors, and the zero input impedance when the output is short circuited that the component values in the second network of the resonant stage should be determined by the following scaling factors:

$$L_1 C_2 = \frac{G_s}{(G_s - 1)\omega^2} \quad L_2 C_2 = \frac{G_s}{\omega^2}$$

It has also been found that the sizes of the reactive components are minimized for a given resistive load, R, when:

$$R = G_s \sqrt{\frac{L_1 + L_2}{C_2}}$$

where:

$L_1$ is the component value of the first series inductor 34;

$L_2$ is the component value of the second series inductor 36;

$C_2$ is the component value of the shunt connected capacitor 38;

$G_s$ is equal to the desired voltage gain (i.e., $V_r/V_{in}$) of the stage;

R is equal to the resistance of the load; and $\omega$ is equal to $2\pi$ times the input frequency.

For unity power factor and for a minimum reactive energy stored in the stage, the component values of the capacitors in the first and third networks should be determined by the scaling factors:

$$L_1 C_1 L_2 C_3 1/\omega^2$$

where:

$C_1$ is the component value of the capacitor 32 in the first network 26; and $C_3$ is the component value of the capacitor 40 in the third network 30.

In one application, the resonance transformer is employed to step up a 2.5 kilovolt, 27 megawatt input signal, having a frequency of 5 kilohertz, to provide a 20 kilovolt output signal. Thus, a gain of 8 and a load of 14.8 ohms is necessary. Using the above scaling factors, the component values are determined to be as follows: $C_1$=45.5 microfarads; $C_2$=52 microfarads; $C_3$=6.5 microfarads; $L_1$=22.2 microhenries; and $L_2$=156 microhenries.

Figure 3:
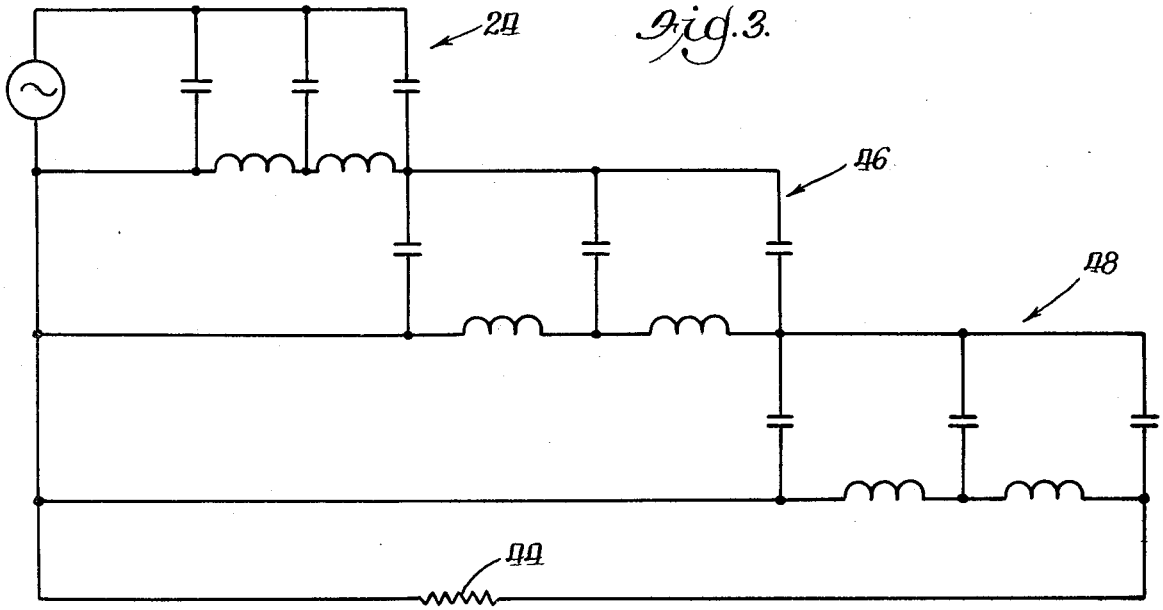
FIG. 3 is a schematic drawing showing a stepped or ladder arrangement of three of the stages shown in FIG. 2.

To provide additional gain in the resonance transformer, one or more resonant stages may be connected in a step or ladder arrangement, as shown in FIG. 3. More particularly, the input of a second resonant stage 46, which is of similar construction to the first stage, is connected as a load for the first stage (i.e., connected in parallel with the series inductors of the first stage) and the input of a third stage 48 is connected as a load for the second stage. By employing the above scaling factors to determine the component values of the stages, the gain of two stages is equal to the square of the gain of one stage and the gain of three stages is equal to the cube of the gain of one stage.

In a specific application, a two-stage ladder arrangement is employed to step up a 2.5 kilovolts, 3 megawatt input signal to provide a 200 kilovolt output signal. The input signal has a frequency of 5 kilohertz. Thus, a gain of 80 and a load resistance of 13.3 kilohms is needed. The gain of each stage is equal to the $\sqrt{80}$ and output impedance of the first stage is 167 ohm. Employing the above scaling factors, the component values of the first stage are equal to: $C_1$ equals 4.8 microfarads; $C_2$ equals 5.4 microfarads; $C_3$ equals 0.61 microfarads; $L_1$ equals 0.21 milihenries; and $L_2$ equals 1.67 milihenries.

In the second stage, the component values are: $C_1$ equal 0.060 microfarads; $C_2$ equals 0.068 microfarads; $C_3$ equals 0.0076 microfarads; $L_1$ equals 16.8 milihenries; and $L_2$ equals 134 milihenries.

Another embodiment of the resonance transformer is the reverse circuit of the stage shown in FIG. 2, that is, inductors of equal impedance are substituted for the shunt capacitors and capacitors of equal impedance are substituted for the series inductors. In such a stage, the scaling factors become:

$$L_2 C_1 = \frac{G_s - 1}{G_s \omega^2}; \; L_2 C_2 = \frac{1}{G_s \omega^2};$$

$$L_1 C_1 = L_2 C_3 = \frac{1}{\omega^2};$$

$$R = G_s \sqrt{\frac{L_2(C_1 + C_2)}{C_1 C_2}} \text{ for optimum loading}$$

In still another embodiment, the resonance transformer can be used in combination with a standard two winding transformer to reduce the mutual reactance required in the transformer and reduce the circuit regulation. In such an embodiment, the central shunt inductor (i.e. the shunt inductor of the second network) of the reverse circuit of FIG. 2 is replaced by the mutual inductance of a transformer. The primary winding of the transformer is connected in series with the first series capacitor of the second network and its secondary winding is connected in series with the second series capacitor. The transformer thus provides part of the gain.

Figure 4:
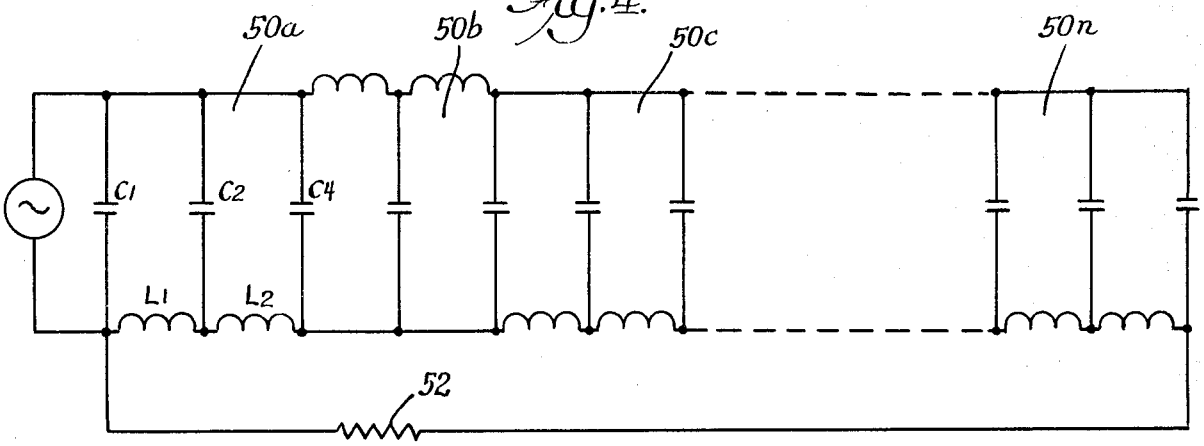
FIG. 4 is a schematic drawing showing a plurality of the stages shown in FIG. 2 coupled in series.

Another embodiment of the resonance transformer is shown in FIG. 4. In this embodiment, the available gain is not as great as the embodiment shown in FIG. 3. In the embodiment shown in FIG. 4, a plurality of resonant stages 50*a*, 50*b*, 50*c* and 50*n* are connected in series. The stages are similar in component arrangement to that of FIG. 2 but instead of the load being connected across the series inductors, the input of a succeeding stage is connected across the shunt capacitor in the third network of the preceding stage. In the drawing, only one capacitor is shown between the stages but it should be understood that the one capacitor is equivalent to the input capacitor of the succeeding stage and output capacitor of the preceding stage. As shown in FIG. 4, the second networks of alternate stages are inverted so that the capacitors in the first and third networks of each stage are connected in series so that the voltage across the capacitors are added. A load 52 is connected in parallel with the series connected capacitors. In FIG. 4, each stage is constructed of like component values to provide a desired gain per stage. The gain of the multistage circuit is equal to $$\frac{G_1^{(n+1)} - 1}{G_1 - 1},$$

where n is the number of stages and $G_1$ is the gain per stage (i.e. $V_o/V_{in}$). The component relationships that provide the desired gain are:

$$\omega^2 L_1 C_2 = \frac{G_1 + 1}{G_1}$$

$$\omega^2 L_2 C_2 = G_1 + 1$$

Figure 5:
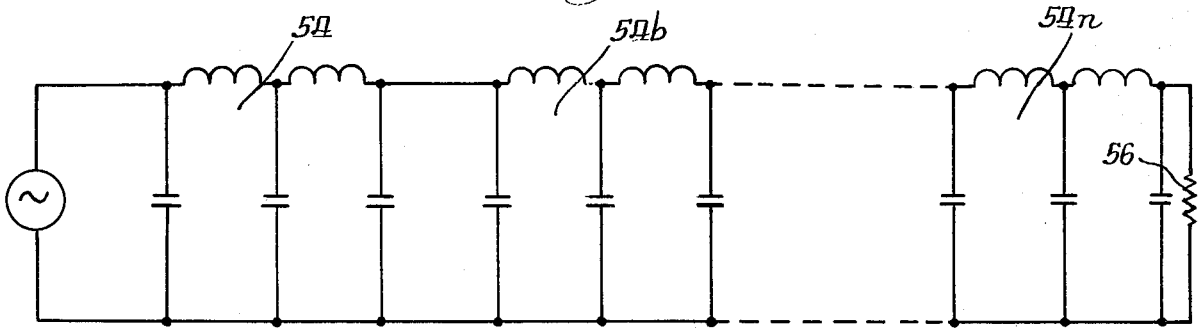
FIG. 5 is a schematic drawing showing another embodiment of the multi-stage series connected arrangement shown in FIG. 4.

Still another embodiment of the resonance transformer is shown in FIG. 5. In this embodiment, the gain is less than that provided in the prior described embodiments. In this embodiment, a plurality of resonant stages 54*a*, 54*b*, 54*n* are connected in series and a load 56 is connected across the output of the last stage. The stages are of same construction to that shown in FIG. 2, but the input of the succeeding stage is coupled across the capacitor in the third network of the preceding stage. The gain of this circuit is equal to $G_1^n$ times the gain of a single stage where n equals the number of stages.

Figure 6:
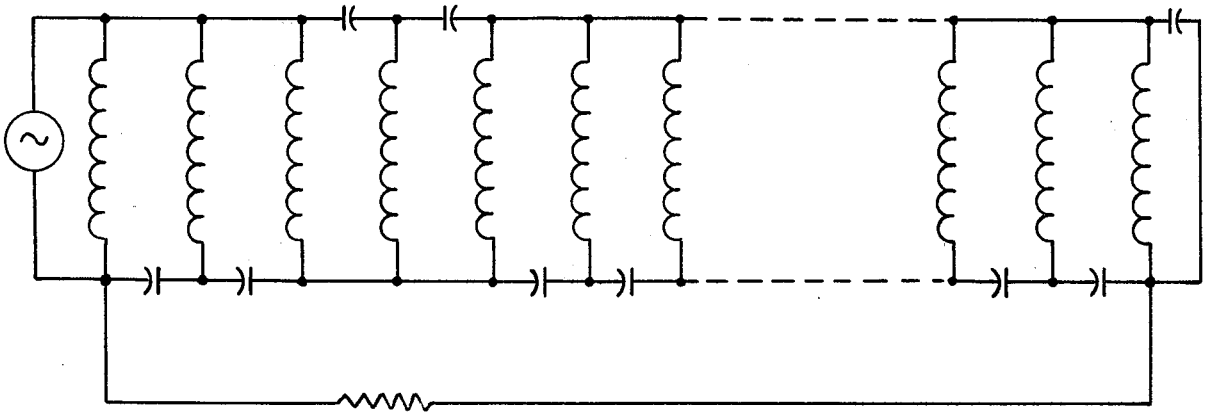
FIG. 6 is a schematic drawing of multi-stage series connected arrangement employing another embodiment of the stage shown in FIG. 2.

Another embodiment of the resonance transformer is shown in FIG. 6. This embodiment is similar to the embodiment of FIG. 4 except that the capacitors and inductors are interchanged. This interchange can be employed in any disclosed embodiments of the circuit.

FIG. 7 shows a version of the resonance transformer including a resonant T-type stage 55 comprised of two T-type circuits 56 and 58 connected in series. The first T-type circuits 56 includes two series connected inductors 60 and 62 and a shunt capacitor 64 connected to the junction between the series connected inductors. The second T-type circuit 58 is similar in construction to the first T-type circuit and includes two series connected inductors 66 and 68, and a shunt capacitor 70 connected to the junction between the series connected inductors. The inductor 62 serving as an output inductor for the first T-type circuit and the input inductor 66 for the second T-type circuit are normally combined into a single inductor $L_2$. A load may be connected across the output $V_o$. However, for maximum voltage gain of the stage, a load 72 should be connected across the series inductors 60, 62, 66 and 68.

In this T-type resonant stage, the reactive energy stored in the stage is determined by the component value of the inductor 62,66. The gain voltage is determined by the component values of inductors 60 and 68 and capacitors 64 and 70. In this connection, the component values of the inductors 60 and 68 and capacitors 64 and 70 are selected so that the stage provides a 180° phase shift at the applied frequency between the phase angle of its input and its output voltage vectors and so that the stage has zero input impedance when its output is short circuited. To obtain this, the following scaling factors should be used:

$$C_1 = (G_s - 1)C_2$$

$$L_1 = \frac{L_3}{G_s - 1}$$

$$L_1 C_1 = \frac{1}{\omega^2}$$

$$L_3 C_2 = \frac{1}{\omega^2}$$

where:

$G_s$ is equal to the desired voltage gain of the stage;

$L_1$ is the component value of the first series inductor 60;

$L_2$ is the component values of the two series inductors 62 and 66;

$L_3$ is the component value of the output series inductor 68;

$C_1$ is the component value of the first shunt capacitor 64;

$C_2$ is the component value of the second shunt capacitor 70; and

R is the resistance of the load 72

To minimize the size of the reactive components the resistance of the load 72 should be selected as follows:

$$R = \frac{G_s}{\sqrt{G_s - 1}} \sqrt{\frac{L_3}{C_2}}$$

For minimum reactive energy stored in the stage, the component value of the inductor 62, 66 should be:

$$L_2 = L_1 L_3$$

when the load is resistive.

To provide additional gain, two or more resonant T-type stages may be connected in a step or ladder arrangement, as shown in FIG. 8. More particularly, the input of a second resonant stage 74, which is of similar construction to the first stage 55, is connected as a load for the first stage (i.e., connected in parallel with the series inductors 60, 62, 66 and 68 of the first stage) and the input of a third stage 76 is connected as a load for the second stage. By employing the above scaling factors to determine the component values of the stages, the gain of two stages is equal to the square of the gain of one stage and the gain of three stages is equal to the cube of the gain of one stage.

In a specific application, a two stage ladder arrangement is employed to step up a 2.5 kilovolts, 3 megawatt input signal to provide a 200 kilovolts output signal. The input has a frequency of 5 kilohertz. Thus a gain of 80 is needed and a load resistance of 13.3 kilohms is needed. The gain of each stage is equal to $\sqrt{80}$ and the output impedance of the first stage is 167 ohm. Employing the above scaling factors, the component values of the first stage are equal to: $C_1$ equals 4.8 microfarads; $C_2$ equals 0.61 microfarads; $L_1$ equals 0.21 milihenries; $L_2$ equals 1.88 milihenries; and $L_3$ equals 1.67 milihenries. In the second stage the component values are: $C_1$ equals 0.06 microfarads; $C_2$ equals 0.0076 microfarads; $L_1$ equals 16.8 milihenries; $L_2$ equals 151 milihenries; and $L_3$ equals 134 milihenries.

Another embodiment of the stage shown in FIG. 7 is provided by replacing the series inductors with series capacitors of equal impedance and replacing the shunt capacitors with shunt inductors of equal impedances.

In FIG. 9, a plurality of the resonant T-type stages 55*a*, 55B and 5*s* are connected in series.

The disclosed resonance transformer provides relatively high gains while requiring lightweight and compact components. A substantial amount of energy is transferred to the load with a minimum reactive energy storage in the components. The resonance transformer has a near constant gain (that is, it has small regulation) over a wide range of loads. Such regulation as does occur is caused by the losses in the components. The resonance transformer acts much like a normal transformer except that the component sizes are much smaller, the transient response is different, and the input to output isolation that can be obtained is less than a transformer. The ladder arrangement provides the highest gain with relatively low components weights compared to the other disclosed systems. Also, the voltage gain of all the arrangements are relatively independent of the load. The ladder arrangement has a much lighter weight for systems with a gain greater than 10 and significantly lighter when the gain is less than 10. Moreover, the ladder arrangement can provide zero voltage and current phase shift or provide power factor correction.

Various changes and modifications may be made in the above described voltage amplifier without deviating from the spirit and scope of the present invention. Various features of the invention are set forth in the accompanying claims.

What is claimed is:

1. An a.c. resonance transformer for operating at a predetermined frequency, comprising a first resonant stage including a first four terminal network, a second four terminal network connected to the output of said first network, and a third four terminal network connected to the output of said second network, said first and said third networks each including a shunt reactor of a first type, said second network including two series connected second type reactors and a first type reactor shunt connected to the junction between said second type reactor, and means for applying said predetermined frequency to the input of said first network, the reactors in said second network having values such as to provide a 180° phase shift at said predetermined frequency between the phase angle of its input and output voltage vectors and to provide a zero input impedance when its output is short circuited.

2. A resonance transformer in accordance with claim 1 wherein said second type of reactor is an inductor and said first type of reactor is a capacitor.

3. A resonance transformer in accordance with claim 2 wherein means are provided to connect a load across the series connected inductors; wherein the first series connected inductor has an inductance equal to $$\frac{G_s}{C_2(G_s - 1)\omega^2},$$

the second series connected inductor has an inductance equal to $G_s/C_2\omega^2$, and the shunt capacitor in the second network has a capacitance equal to $G_s/L_2\omega^2$ where: $G_s$ is equal to the desired voltage gain of the stage; $\omega$ is equal to $2\pi$ times the input frequency; and $L_2$ is the inductance of the second series connected inductor.

4. A resonance transformer in accordance with claim 2 wherein said shunt reactors in said first and said third network are capacitors, the capacitor in said first network having a value preselected to provide a desired power factor of said stage, the capacitor in said third network having a value preselected to provide a minimum of energy storage in said stage.

5. A resonance transformer in accordance with claim 4 wherein the shunt capacitor in said first network has a capacitance equal to $1/L_1\omega^2$, and the shunt capacitor in said third network has a capacitance equal to $1/L_2\omega^2$ where: $L_1$ is the inductance of the first series connected inductor and $L_2$ is the inductance of the second series connected inductor.

6. A resonance transformer in accordance with claim 3 wherein the shunt capacitor in said first network has a capacitance equal to $1/L_1\omega^2$, and the shunt capacitor in said third network has a capacitance equal to $1/L_2\omega^2$ where: $L_1$ is the inductance of the first series connected inductor and $L_2$ is the inductance of the second series connected inductor.

7. A resonance transformer in accordance with claim 1 wherein a second resonant stage having the same type of construction as said first stage is coupled as a load to said first stage, the input of said second stage being coupled across said series connected reactors.

8. A resonance transformer in accordance with claim 3 wherein a second resonant stage having the same type of construction as said first stage is coupled as a load to said first stage, the input of said second stage being coupled across said series connected reactors.

9. A resonance transformer in accordance with claim 6 wherein a second resonant stage having the same type of construction as said first stage is coupled as a load to said first stage, the input of said second stage being coupled across said series connected reactors.

10. A resonance transformer in accordance with claim 1 wherein a plurality of resonant stages having the same type of construction as said first stage are coupled in series with the input of a succeeding stage being coupled to the output of a preceding stage, which output it taken across the shunt reactor of the third network, and wherein a load is coupled across the output of the last stage.

11. A resonance transformer in accordance with claim 4 wherein a plurality of resonant stages having the same type of construction as said first stage are coupled in series with the input of a succeeding stage being coupled to the output of a preceding stage, which output is taken across the shunt reactor of the third network, and wherein a load is coupled across the output of the last stage.

12. A resonance transformer in accordance with claim 1 wherein a plurality of resonant stages having the same type of construction as said first stage are coupled in series with the input of a succeeding stage being coupled to the output of a preceding stage and with second networks of alternate stages being inverted, whereby the reactors of said first networks and said third networks are coupled in series by said series reactors of said second networks, and wherein a load is coupled in series with said series coupled reactors.

13. A resonance transformer in accordance with claim 2 wherein a plurality of resonant stages having the same type of construction as said first stage are coupled in series with the input of a succeeding stage being coupled to the output of a preceding stage and with second networks of alternate stages being inverted, whereby the reactors of said first networks and said third networks are coupled in series by said series reactors of said second networks, and wherein a load is coupled in series with said series coupled reactors.

14. An A-C resonance transformer for operating at a predetermined frequency, comprising a first resonant stage including two T-type circuits, each of said circuits including two series connected first type reactors and a second type reactor shunt connected to the junction between said first type reactors, and means for applying said predetermined frequency to the input of said first $\pi$-type circuit, the reactors in said T-type circuits having values such as to provide a 180° phase shift at said predetermined frequency between the phase angle of the input and output voltage vectors of said stage and to provide a zero input impedance when output of said stage is short circuited.

15. A resonance transformer in accordance with claim 14 wherein said first type of reactor is an inductor and said second type of reactor is a capacitor.

16. A resonance transformer in accordance with claim 15 wherein means are provided to connect a load across the series connected inductors; wherein the first series connected inductor has an inductance $L_1$ equal to $L_3$, the shunt connected capacitor of the first circuit has a capacitance $C_1$ equal to $1/L_1\omega^2$, and the shunt capacitor in the second circuit has a capacitance $C_2$ equal to $C_1/(G_s-1)$ where: $G_s$ is equal to the desired voltage gain of the stage; $\omega$ is equal to 2 $\pi$ times the input frequency; and $L_3$ is the inductance of the last series connected inductor.

17. A resonance transformer in accordance with claim 16 wherein the output inductor of the first circuit and the input inductor of the second circuit have a total inductance such as to provide a minimum of energy storage in said stage.

18. A resonance transformer in accordance with claim 15 wherein the total inductance is equal to inductance of the two inductors.

19. A resonance transformer in accordance with claim 15 wherein a second resonant stage having the same type of construction as said first stage is coupled as a load to said first stage, the input of said second stage being coupled across said series connected reactors.

20. A resonance transformer in accordance with claim 16 wherein a second resonant stage having the same type of construction as said first stage is coupled as a load to said first stage, the input of said second stage being coupled across said series connected reactors.

21. A resonance transformer in accordance with claim 17 wherein a second resonant stage having the same type of construction as said first stage is coupled as a load to said first stage, the input of said second stage being coupled across said series connected reactors.

22. A resonance transformer in accordance with claim 14 wherein a plurality of resonant stages having the same type of construction as said first stage are coupled in series with the input of a succeeding stage being coupled to the output of a preceding stage and with alternate stages being inverted, which output is in series with the second series reactor of the second circuit, and wherein a load is coupled across the output of the last stage.

23. A resonance transformer in accordance with claim 15 wherein a plurality of resonant stages having the same type of construction as said first stage are coupled in series with the input of a succeeding stage being coupled to the output of a preceding stage and with alternate stages being inverted, which output is in series with the second series reactor of the second circuit, and wherein a load is coupled in series with said series connected stages.

* * * * *

UNITED STATES PATENT AND TRADEMARK OFFICE

CERTIFICATE OF CORRECTION

PATENT NO. : 4,274,046

DATED : June 16, 1981

INVENTOR(S) : John L. Harrison

It is certified that error appears in the above—identified patent and that said Letters Patent is hereby corrected as shown below:

Column 3 line 40, insert a space between the two equations.

Column 3 line 60, "wis" should be --w is--.

Column 3 line 65, "$L_1C_1L_2C_3 1/w^2$" should be --$L_1C_1=L_2C_3=1/w^2$
Spec. page 8 line 4

Column 6 line 24, "$L_3C_2=1/w^2$" should be --$L_3C_2$ $1/w^2$

Column 6 line 37, after "72" insert period --.--
15

Column 6 line 48, "$L_2=L_1L_3$" should be --$L_2=L_1+L_3$

Column 7 line 17 should "55B and 5s" be --55b and 55n--?
line 5

Column 9 line 26,"Π-type" should be --T-type--.

Signed and Sealed this

Eighth Day of December 1981

[SEAL]

Attest:

GERALD J. MOSSINGHOFF

Attesting Officer

Commissioner of Patents and Trademarks